United States Patent [19]

Ohl

[11] Patent Number: 4,552,406

[45] Date of Patent: Nov. 12, 1985

[54] CHAIR

[75] Inventor: Herbert Ohl, Darmstadt, Fed. Rep. of Germany

[73] Assignee: Wilkhahn Wikening & Hahne GmbH & Co., Fed. Rep. of Germany

[21] Appl. No.: 458,925

[22] Filed: Jan. 18, 1983

[30] Foreign Application Priority Data

Mar. 2, 1982 [DE] Fed. Rep. of Germany ..... 3207352

[51] Int. Cl.[4] ..... A47C 1/12

[52] U.S. Cl. ..... 297/445; 160/394; 403/396; 403/391; 297/449

[58] Field of Search ..... 297/445, 447, 449, 226, 297/457; 160/392, 394, 399, 397, 395, 398; 403/396, 391, 390

[56] References Cited

U.S. PATENT DOCUMENTS

| | | | |
|---|---|---|---|
| 1,553,862 | 9/1925 | Kirsch | 160/399 X |
| 3,041,109 | 6/1962 | Eames et al. | 297/449 |
| 3,143,165 | 8/1964 | Lewis et al. | 160/394 |
| 3,425,028 | 1/1969 | Neaderland | 403/390 X |
| 3,604,752 | 9/1971 | Macknick | 297/455 |
| 3,891,270 | 6/1975 | Crossman et al. | 297/347 |

*Primary Examiner*—Kenneth Downey

*Attorney, Agent, or Firm*—Antonelli, Terry and Wands

[57] ABSTRACT

In order to create an elegant and light seat or chair, which nevertheless has stability comparable to sturdy utility chairs, a chair is proposed which includes a seat portion and a backrest portion with each of the portions including a flexible flat structure clamped to metal frame elements. Each metal frame element is provided with a longitudinal groove which accommodates a compressible metal which is pressed into the groove while binding the edge of the flat structure. The metal frame elements are preferably formed of extruded aluminum rod material with the groove being provided with undercuts forming barbs. A soft aluminum wire is employed as the compressible metal. The flexible flat structure may take the form of a web or a net type material.

54 Claims, 18 Drawing Figures

CHAIR

The present invention relates to a chair having a seat and a backrest and, more particularly, to a chair wherein at least a portion thereof includes a flat flexible structure adapted to be clamped into a longitudinally extending groove of a metallic frame member, with a metallic member being pressed into the longitudinal groove so as to bind a border of the flexible structure to the metallic frame member.

In upholstered-chair manufacturing, foamed material members are generally placed on hard membranes, tightened belts or tightened webs and this approach generally results in voluminous heavy upholstered chairs often offering poor support of the contact surfaces of a body of a user as well as the generation and localization of heat at contact surfaces of the users body with the upholstered chair.

In textile-covered chairs without upholstered padding such as, for example, chairs disclosed in, for example, U.S. Pat. No. 3,512,834, French Pat. No. 1,027,586, and United Kingdom Published Application 2,020,175, only the textile material is tightened. However, the fastening of flexible structures of the textile covered chairs presents difficulties when the metal frame members are located essentially only at one level. Moreover, since the resulting chairs of this type have only a very simple appearance and are not readily adapted to the support or contact surfaces of a user's body, the retaining of the textile material at the frame is usually visible, making such chairs aesthetically less appealing. Furthermore, the horizontally clamped textile material in these type chairs is often subjected to too much stress.

More complex types of chairs which are better adapted to the body of a user can be obtained by employing metal frames which are bent or formed as three dimensional curves in space. However, with these types of complex chairs, it is difficult to anchor the flexible structure in a stable manner and to tighten it at the same time as well as to connect the chair and frame parts with one another.

The aim underlying the present invention essentially resides in providing a chair having an appearance that shows more adaptability and lightness, a stability comparable to that of a sturdy utility chair, and body contact surfaces, permeable with respect to heat and perspiration, having a supporting shape with optimal static and dynamic adaptability, while utilizing only a few construction elements with small dimensions for connecting the main parts of the chair to each other.

In accordance with advantageous features of the present invention, frame members of the chair are provided with a longitudinally extending grooves having walls provided with undercuts forming barbs. A binding or holding member in the form of, for example, a metal piece, formed of a compressible metal, is pressed into the undercuts.

Advantageously, the metal frame members may be formed of extruded rod material or extrusion profiles of, for example, a hard alloy. A soft metallic wire such as, for example, a soft aluminum wire, is preferably utilized at the compressible material of the binding or holding member. The flat flexible structure adapted to be secured to the frame members may be of a web or net type and, with a net-type flat flexible structure, preferably, such structure is made of braided, knitted or woven single or multiple synthetic threads.

Extensive testing has demonstrated that a metallic pressed or compressed connection such as proposed by the present invention can result in a very stable clamping of the flat structure to the metal frame, in which case, suprisingly, the flat flexible structure in an area of the compressed connections, maintains its complete stability. This fact is especially demonstrated in net-type flat flexible structures since the compressible material can be pressed through the meshes of the net-type structures into the undercuts of the groove on the side of the frame, after which the threads of the net-like material, acting as a reinforcement, are embedded and anchored in the compressible metal.

Advantageously, in accordance with still further features of the present invention, the walls of the longitudinally extending groove may extend angularly with respect to adjacent areas of the flat flexible structure. Preferably, the longitudinally extending groove is, according to the present invention, disposed at a top side of the metal frame facing the user, with a further longitudinally extending groove being provided at the metal frame at a predetermined angular distance with respect to the first groove below the flat structure. Preferably, the angular distance is greater than 90°.

In order to optically conceal or mask the fastening point of the flexible flat structure, an appropriate substantially C-shaped padding strip is provided and is fastened in the two grooves provided in the respective metal frame members.

Advantageously, in accordance with the present invention, the metal frames of the seat and the back, with reference to the user, on both sides of the chair are bent or curved convexly and, in the front and rear, are bent or curved concavely.

According to the present invention, the metal frame members of the seat portion and backrest may be provided with sections that are parallel to one another, with a curved or arcuate clamping member, having an approximately C-shaped cross sectional configuration, being provided for clamping the metal frame members to each other by an arcuate or curved closing strip inserted between the sections. In this manner, a fastenerless, inconspicuous, but yet extremely stable connection is achieved between the seat portion and backrest of the chair.

Advantageously, in a longitudinal center area of the clamping member, a bracing tube is secured by, for example, welding or the like, with the bracing or support tube extending under the seat portion and being bent downwardly. The bracing or support tube supported on a socket or connecting member mounted on a pedestal or leg of the chair by means of connecting pins or a vertically adjustable self-locking pneumatic cylinder-piston unit. By appropriate selecting the connecting members or pin means of different lengths, it is possible for one to readily comfortably adjust the sitting height of the chair.

In order to enable the chair to be rotated about a vertical axis, in accordance with the present invention, an axial thrust bearing arrangement is advantageously disposed in the connecting member on a side of the pedestal or leg, with at least one of the connecting means being supported by the bearing arrangement.

The chair of the present invention may be provided with one or more arm rests each of which is formed on an arched piece having a central section or area which extends approximately parallel to the parallel metal frame sections. The central section of the arm rests are provided with a groove on a backside thereof so as to enable the curved or arcuate piece of the arm rest to be pressed tightly onto the closing strip. In this manner, the arm rests are also mounted on the chair in a stable manner through a fastnerless connection.

The support or bracing tube, mounted at a position beneath the seat portion of the chair and bent downwardly, may be provided with a conical lower end adapted to be mounted on a tapered upper end of a connecting member fastened at a pedestal or leg portion of the chair.

Advantageously, a tubular connecting member may be mounted at the pedestal or leg portion of the chair, with the tubular connecting member adapted to accommodate a further connecting member. An axial thrust bearing arrangement is disposed within the connecting member so as to enable the further connecting member to be rotatably mounted thereon. The connecting member may taper at a lower end thereof and be inserted into a conical receiving hole of the pedestal or leg portion of the chair and, advantageously, a center area of one of the connecting members may be enclosed by a slide shell or shell of a friction reducing material lining a central cylindrical portion of the connecting member.

The pedestal or leg portion of the chair may be substantially disc shaped and may take the form of a round metal disc having a plurality of sliding leg portions at peripheral edge portions thereof. A pneumatic self-locking cylinder and piston unit for enabling an adjustment of the height may be employed to connect the support or bracing tube with the connecting member mounted at the pedestal or chair leg. The pneumatic cylinder-piston unit may include a cylinder rotatably arranged in a connecting member with a piston rod of the pneumatic cylinder-piston unit being supported by a axial thrust bearing arrangement disposed at a lower end of a connecting member mounted at the pedestal or leg portion of the chair.

In order to enable a connecting of the frame means for the seat and backrest portion to each other, it is possible to provide a joint at an upper end of the support or bracing tube whereby, through the use of suitable fasteners such as screws or appropriately configured pin means, the joint may be mounted at a clamping piece and the frame means.

By virtue of the features of the present invention, a chair results which has a high usefulness as well as a large number of advantages. On the one hand, the resulting chair is optically largely transparent thereby making it possible to readily integrate the chair into various interiors. Additionally, a padding effect is achieved by means of only a very small volume, for example, by means of a net that may only be about 1 mm thick.

Furthermore, with a chair of the present invention, the body contact surfaces of the chair are permeable for enabling a heat flow and a heat exchange between the body and the environment as well as for a vapor diffusion or perspiration to the atmosphere which is very important when a chair is used for prolong sitting such as during work, etc.

Furthermore, the chair of the present invention offers a high adaptation of the contact surfaces to the body during the primary sitting position and a largely automatic adaptation of the contact surfaces to secondary or changed sitting positions which occur, for example, during work. In this connection, the adaptation of the chair to the body is not achieved by elasticity of material or compression of material but rather by a deformation of the net material without stretching a length so that a flexible and changing adaptation is achieved with continuously high support of the body contact surfaces.

Since the connection area of the main parts are concealed, such connection areas are effectively invisible yet are capable of receiving a simultaneous homogenous distribution of the load applied to the chair. Furthermore, by virtue of the provision of a curved leg connection, it is only necessary to provide a minimum number of construction elements. Also, a curved leg or support in connection with a flat plate-shaped pedestal or base disc advantageously results in the providing of a large amount of clear leg space.

Furthermore, the chair of the present invention provides an overall seat construction having good elasticity which is achieved by a ring-shaped crimping of the base of leg plate, a curved shaping of the support member or support leg, by a projection of a seat frame surface, by a connection of frame parts by means of elastic closing strips, and by a net material covering which is adapted to change shape without any longitudinal stretching.

Accordingly, it is an object of the present invention to provide a chair of the aforementioned type which avoids, by simple means, shortcomings and disadvantages encountered in the prior art.

Another object of the present invention resides in providing a chair arrangement which is simple in construction and therefore relatively inexpensive to manufacture.

Yet another object of the present invention resides in providing a chair construction which ensures a secure fastening of material of the chair with a minimum number of fastening or securing means.

A still further object of the present invention resides in providing a chair construction which readily adapts to various positions of a body of a user of the chair.

These and other objects, features, and advantages of the present invention will become more apparent from the following description when taken in connection with the accompanying drawings which show, for the purposes of illustration only, several embodiments in accordance with the present invention, and wherein.

Figure 11A:
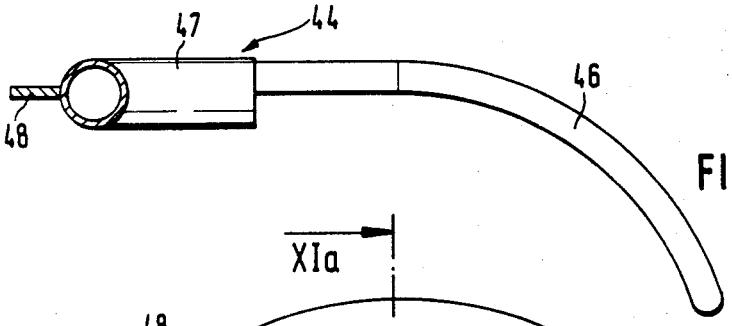
Figure 11B:
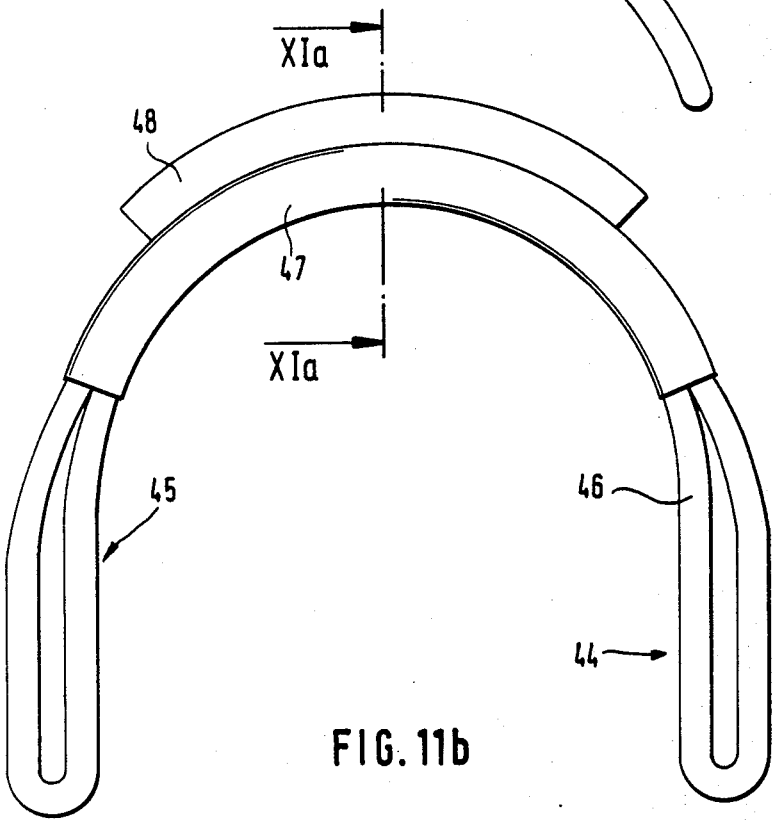

FIG. 11*a* is a partially schematic side view of another embodiment of arm rests for a chair constructed in accordance with the present invention;

FIG. 11*b* is a top plan view of the arm rest of FIG. 11*a;*

Figures 12, 13:
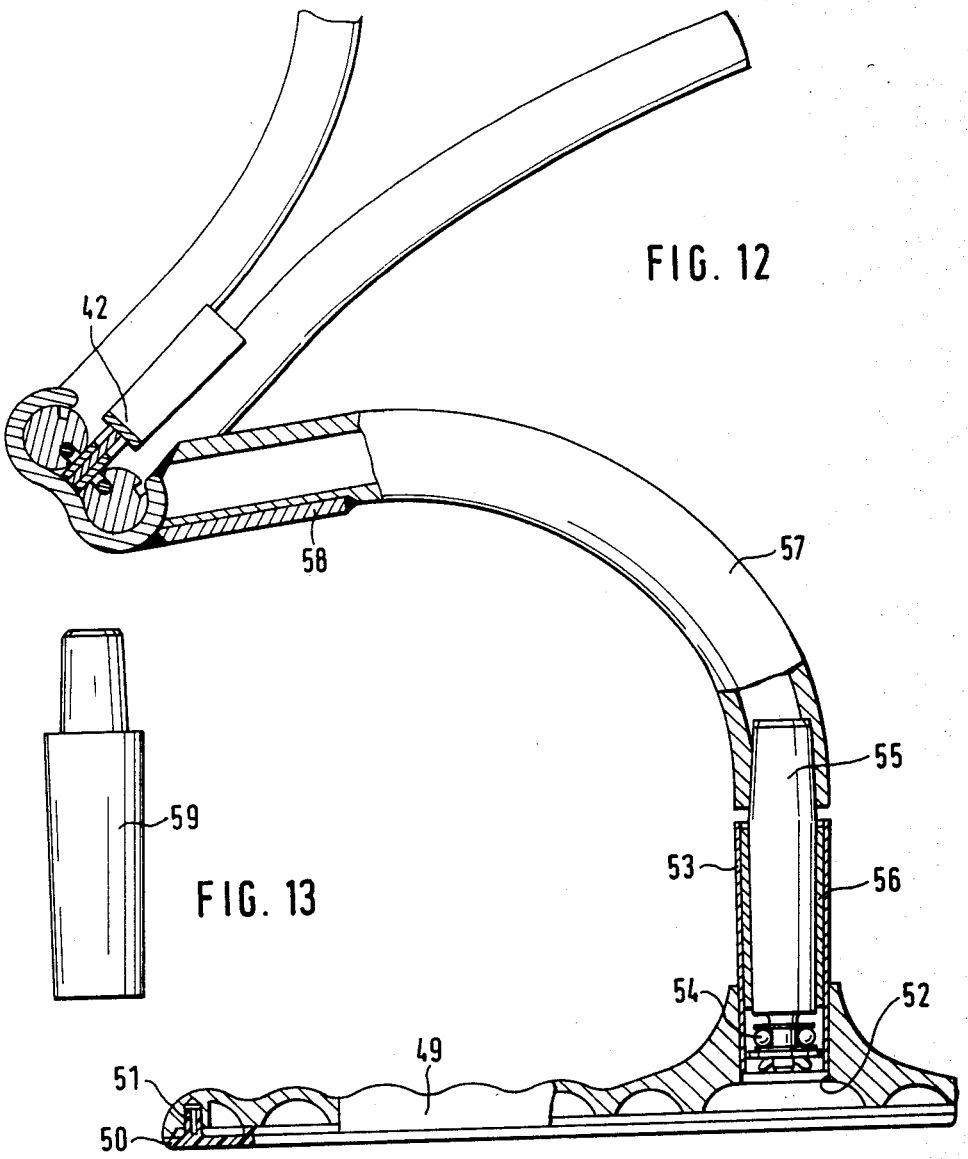
Figure 14:
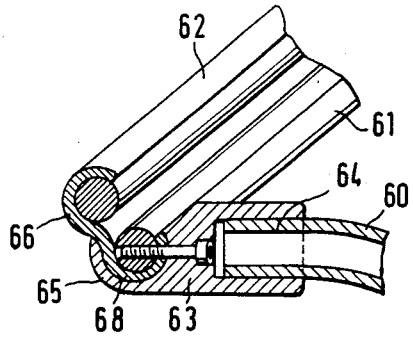
Figure 15:
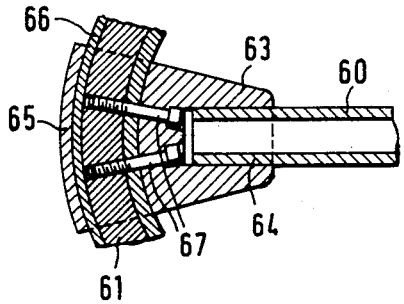
Figure 16:
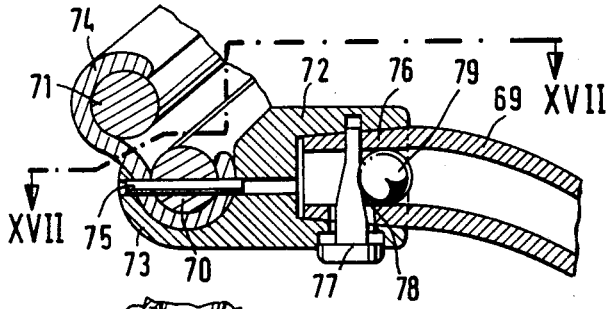
Figure 17:
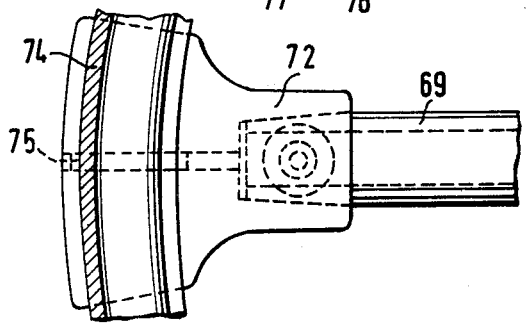

FIG. 12 is a partial cross sectional view of a modified support or understructure for a chair constructed in accordance with the present invention;

FIG. 13 is a plan view of a rigid non-rotating connecting element forming a portion of a support structure for a chair constructed in accordance with the present invention;

FIG. 14 is a vertical cross sectional view of a modified embodiment of a connecting or junction area of a seat frame and back rest frame with a support or bracing tube;

FIG. 15 is a horizontal cross sectional view of the embodiment of FIG. 14;

FIG. 16 is a partial cross sectional view of yet another embodiment of a connection or junction area between a seat frame, a backrest frame, and a support or brace tube; and FIG. 17 is a plan view of the embodiment of FIG. 16.

Figure 1:
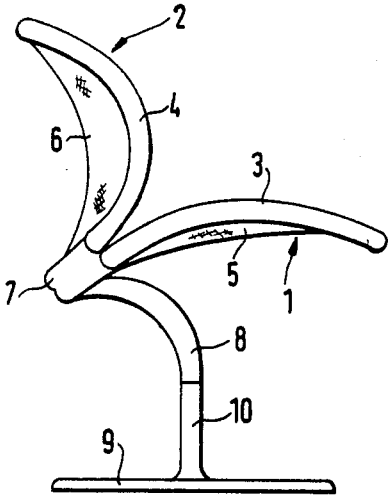
FIG. 1 is a partially schematic side view of a first embodiment of a chair constructed in accordance with the present invention.
Figure 2:
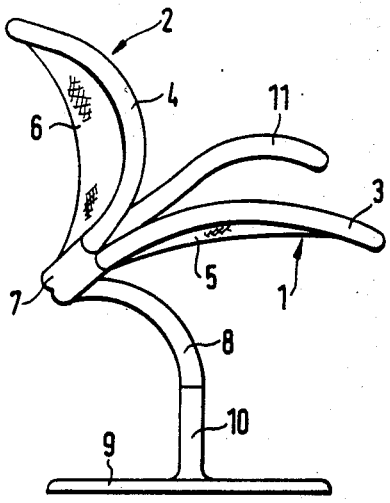
FIG. 2 is a partially schematic side view of another embodiment of a chair constructed in accordance with the present invention provided with arm rests.

Referring now to the drawings wherein like reference numerals are used throughout the various views to designate like parts and, more particularly, to FIGS. 1 and 2, according to these figures, a chair includes a seat portion generally designated by the reference numeral 1 and a backrest generally designated by the reference numeral 2 and, optionally, arm rest 11. The seat portion 1 and back rest 2 respectively include a frame member 3, 4 formed, for example, from a metallic material, with the frame members 3, 4 then being respectively covered by a flat textile structure 5, 6. An arcuate or arched clamping member 7 is provided for holding the two metallic frame members 3, 4 together. The clamping member 7 has an approximately double C-shaped cross sectional configuration, with a bracing or support member 8 in the form of, for example, a tube, being mounted or secured by, for example, welding or the like in a center area of the clamping member 7. The support member 8 extends below the seat portion 1 and is bent downwardly, with a tubular connecting member 10 being arranged between the support member 8 and a pedestal base 9.

The arm rests 11 of the chair in FIG. 2 may, for example, be fashioned as a single bent piece with a center section of the arm rest 11 being fastened at the chair in a vicinity of the clamping member 7.

Figure 3:
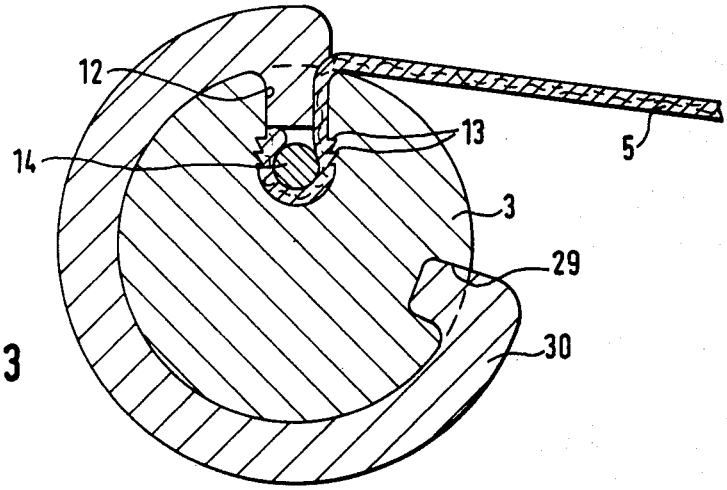
FIG. 3 is a cross sectional detail view, on an enlarged scale, through a frame member of a seat or backrest of the chairs of FIG. 1 or 2.

The frame member 3 may be formed, for example, as an extruded hard aluminum rod bent into a closed ring which, as shown in FIG. 3, is contoured such that the portion of the frame member 3 disposed on the respective lateral sides of the chair is bent convexly upward; whereas, a longitudinal center of the chair at a front and rear end of the seat portion 1, the frame member 3 is bent concavely downwardly whereby, when the flat textile structure 5 is clamped in, the stretched structure 5 forms an arched surface having two oppositely directed bends.

Figure 4:
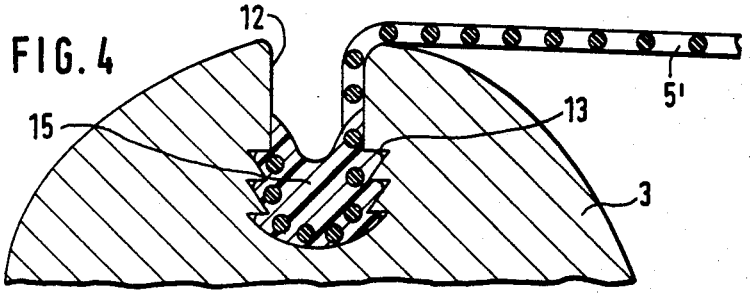
FIG. 4 is an enlarged cross sectional detail view illustrating an anchoring of a chair covering to a metal frame member.

As shown most clearly in FIGS. 3 and 4, a topside of the frame member 3 is provided with a longitudinally extending groove 12 having side walls, at least a portion of which are provided with undercuts 13 forming barbs. A soft metallic member such as, for example, a soft aluminum wire 14 is tightly pressed into the groove 12 thereby binding the border areas of the flat textile structure 5 to the frame member 3. FIG. 3 provides an example of approximate proportions that develop when a tightly woven fabric forms the flat flexible structure 5 which is pressed into the undercuts 13. As can readily be appreciated, the metal frame member 4 is also provided with a longitudinally extending groove 12 for enabling the securing of the flat textile structure 6 thereto whereby the backrest 2 is formed.

If the flat flexible structure is formed of a net material 5′ of, for example, tear-resistant synthetic threads, an even tighter clamping of the structure to the frame members 3, 4 may be achieved for, during a pressing in of the metallic member such as, for example, a compressible or squeezable soft aluminum, aluminum alloy, soft copper, or copper alloy member into the groove, the compressed metal penetrates through the meshes of the net 5′ and into the undercuts, after which the edge area of the net material 5′ is embedded in the compressible metal and the member formed by the compressible metal is, in a form locking manner, anchored in the undercuts 13. If the net material 5′ is used to form the backrest 2, the net material would be secured to the frame member 4 of the backrest 2 in the same manner as described in connection with FIGS 3 and 4.

Figure 5:
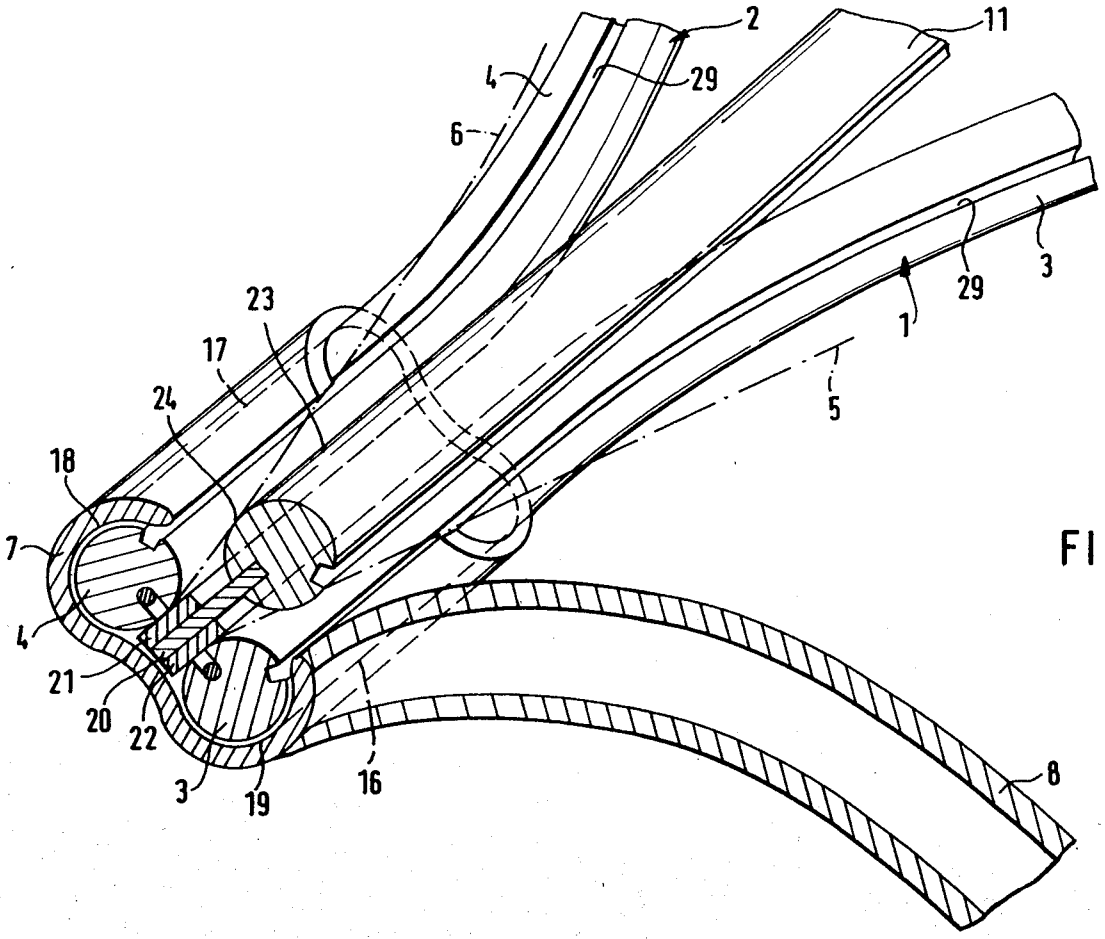
FIG. 5 is a vertical cross sectional view of a junction or connection area of a backrest, armrest, seat portion, and support tube of a chair constructed in accordance with the present invention.

As shown in FIG. 5, at a rear area of the chair, a junction is formed wherein the backrest 2, arm rest 11, if provided, and seat portion 1′, as well as the support member 8 are connected with one another. The metal frame members 3, 4, are rear and lower areas thereof are provided with parallel longitudinally extending sections 16, 17 which extend through the arched or arcuate clamping member 7 which, as noted above, has an approximately —C-shaped cross sectional configuration. The longitudinally extending sections 16, 17 lie, in each case, in a narrow fitting manner, in the upper or lower substantially semi-circular receiving portions 18, 19 of the clamping member 7 and are clamped tightly into the clamping member 7 by a closing strip 20 which may, for example, be formed of an metallic member. The wedge or closing strip 20 may be forced between the longitudinally extending sections 16, 17; however, to protect against a shearing off or other damage to the flat textile structure 5, 6, 5′, advantageously, additional strips 21, 22 of resilient material such, as for example, rubber may be interposed between the closing strip 20 and the longitudinally extending section 16, 17.

As also shown in FIG. 5, the armrest 11, at a center area 23 thereof, extends in parallel to the longitudinally extending sections 16, 17. The longitudinally extending groove 24 is provided in a rear area of the arm rest 11 thereby enabling the arm rest 11 to be pressed on a rim of the strip 20 projecting outwardly from the profile of the clamp member 7.

Figures 6, 8:
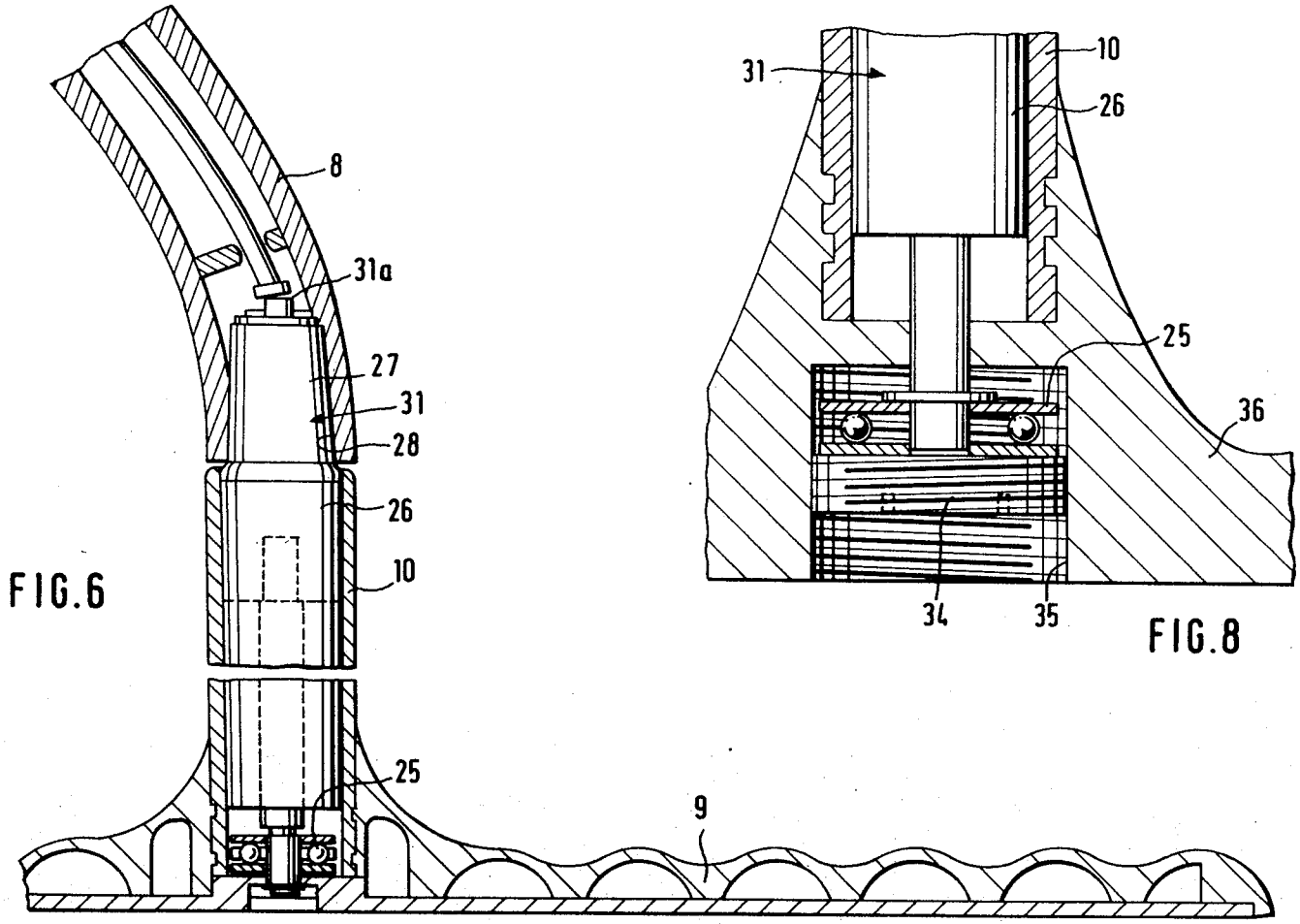
FIG. 6 is a longitudinal cross sectional view of a pedestal or leg portion of a chair constructed in accordance with the present invention.
FIG. 8 is a partial cross sectional view of a portion of a pedestal base or leg of a chair constructed in accordance with the present invention.
Figure 7:
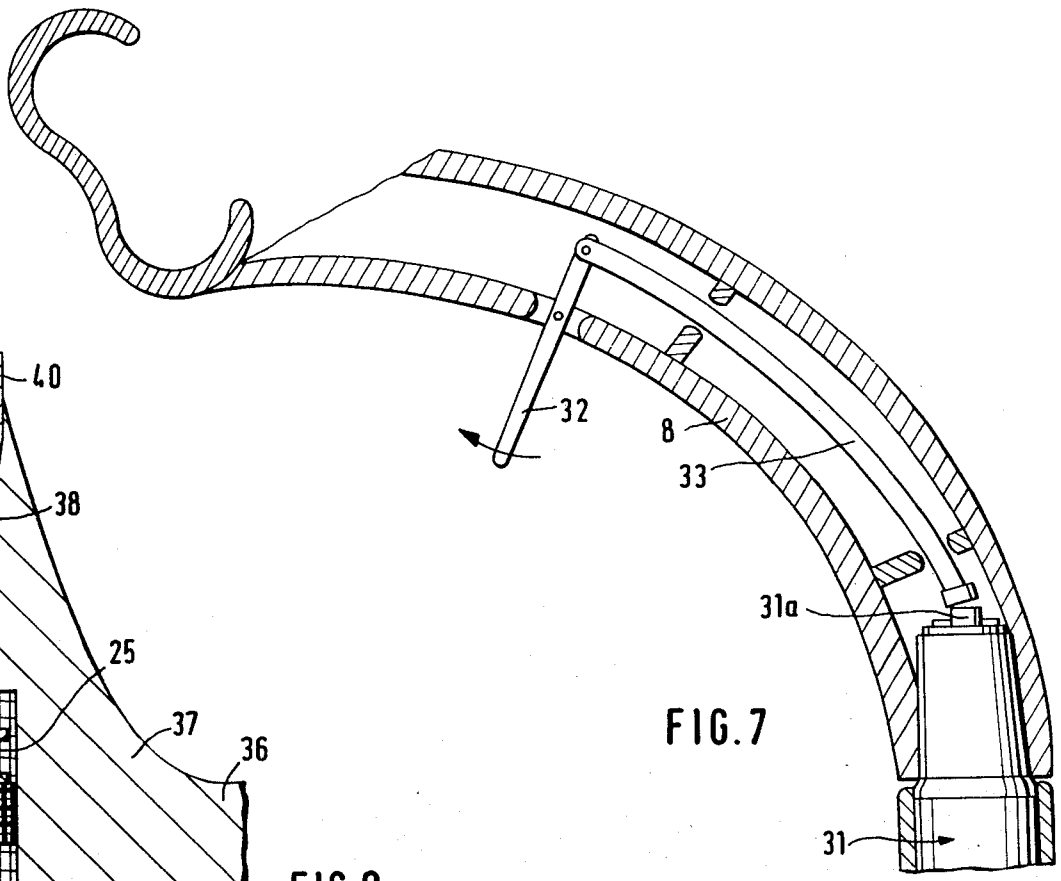
FIG. 7 is an enlarged cross sectional detail view of a vertical adjustment means for the pedestal or leg of the chair of FIG. 6.

As shown in FIG. 6, the chair of the present invention includes a support pedestal or base 9 which includes a plate having connected thereto a tubular connecting member 10. An axial thrust bearings 25, in the form of, for example, ball bearing means, is disposed in a lower area of the tubular connecting member 10. For enabling a height adjustment of the chair, a self-locking pneumatic cylinder-piston means generally designated by the reference numeral 31, of conventional construction, is disposed in the tubular connecting member 10 and support member 8. The cylinder-piston means 31 includes a piston means P separating two high pressure chambers, with a release pin or valve tappet 31*a* being provided for controlling an equalization of the pressure in the pressure chambers thereby enabling a height adjustment of the chair.

The pneumatic cylinder-piston means 31 also includes a housing accommodating the piston means P, with the housing being of bi-partite construction and including a lower cylindrical housing part 26 rotatably and axially slidably mounted in the tubular connecting member 10, and an upper tapered or conical housing part 27 adapted to be accommodated in the bracing or support member 8. A lower end of a piston rod R is rotatably supported by the axial thrust bearing 25. The lower end of the bracing or support member 8 terminates in a tapered or conical receiving opening 28 for accommodating the upper housing parts 27 of the pneumatic cylinder-piston means 31.

To enable a height adjustment of the chair, the valve tappet 31*a*, projecting above a top portion of the pneumatic cylinder-piston means 31, is actuated by a pivoting of an actuating lever 31 pivotally mounted in the brace or support member 8. A shiftable displaceably mounted force transmission means 31 such as, for example, a rod, cable, or the like, is interposed between the lever 32 and valve tappet 31*a*, whereby an adjustment of the sitting height can be carried out by simply pressing the lever 32 in an actuating direction.

As also shown in FIG. 3, the metal frame member 3 and, for that matter, the metal frame member 4, is provided with another longitudinally extending groove 29 angularly spaced from the longitudinally extending groove 12 by an angular distance of greater than 90°. The groove 29 is located below the seat portion 1 in the metal frame member 3 and behind the backrest portion 2 in the metal frame member 4. A substantially C-shaped padding strip 30 is provided with angled or bent portions adapted to be clamped into the groove 29 and groove 12 so that a padding strip optically conceals the fastening point of the flat flexible structure 5, 6, 5' at the metal frame members 3, 4 as well as concealing the metal frame members 3, 4 themselves.

As shown most clearly in FIG. 8, the axial thrust bearing 25 supporting the pneumatic self-locking cylinder-piston means 31 is advantageously mounted on a bearing block or threaded end plate 34 which is adapted to be threadably inserted into a threaded hole 35 provided in a portion of a base plate 36. The threaded hole 35 opens in a downward direction so as not to be visible once the chair is in use. The threaded member 34 allows for a vertical adjustment of the pneumatic cylinder-piston means 31 with respect to the tubular connecting member 10 thereby enabling an accounting of manufacturing tolerances in an area of a gap between the tubular connecting member 10 and the bracing or support member 8.

Figure 9:
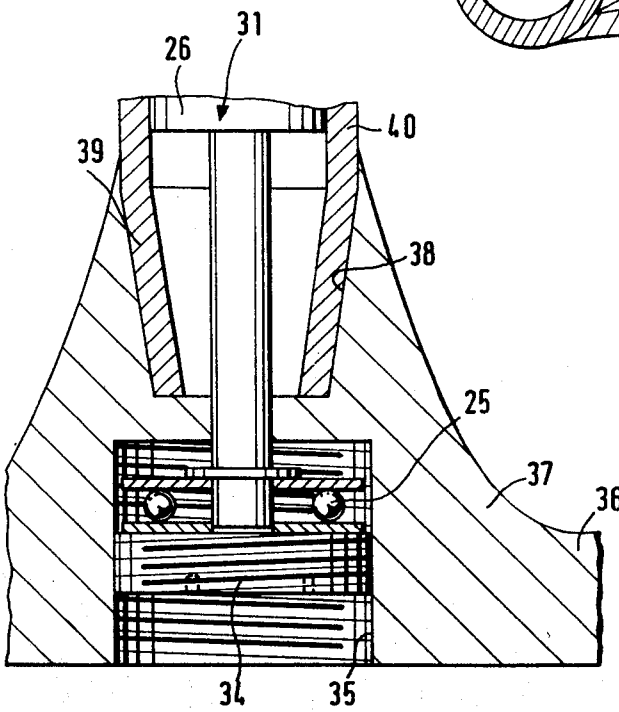
FIG. 9 is a partial cross sectional view of a modified embodiment of a vertical adjustment device for a pedestal or leg constructed in accordance with the present invention.

In the constructions of FIGS. 6 and 8, the pedestal bases are advantageously directly cast to the tubular connecting member 10; however, as shown in FIG. 9, it is possible to provide a central area 37 of the base 36 with a tapered or conical receiving opening 38 adapted to accommodate a connecting member 40 having a corresponding tapered or conical bottom end 39.

Figure 10:
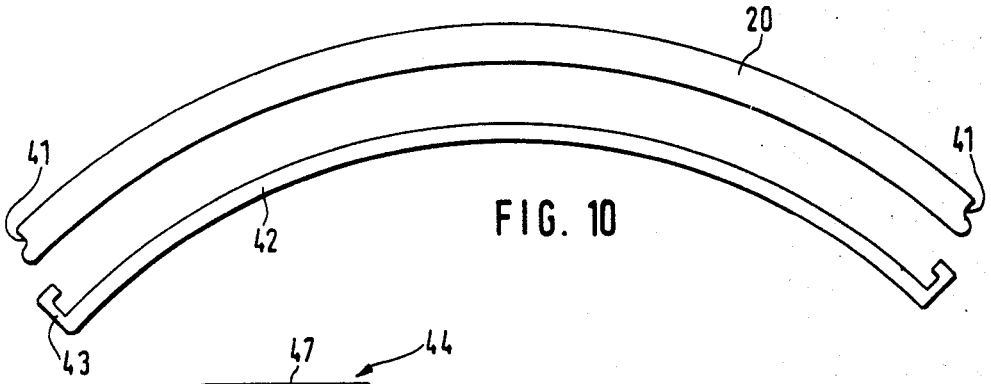
FIG. 10 is an exploded view of a closing strip and associated cover strip used for wedging of a seat frame and back rest frame of a chair constructed in accordance with the present invention.

FIG. 10 provides an example of a bowed or arched closing strip 20 which may be readily utilized at the junction area illustrated in FIG. 5. The closing strip 20 is provided with recesses 41 at opposite ends thereof on the convex side of the strip 20 if the chair is to be provided without arm rests, the closing strip may, at its front edge, be covered by a bowed or arched strip 42 adapted to be snapped onto the closing strip 20 in a spring-like manner, with the hook ends 43 of the strip 42 being engageable in the recess 41 of the closing strip 20.

As shown in FIGS. 11*a* and 11*b*, two arms rests generally designated by the reference numerals 44, 45 may be provided with each arm rest including a wire bow 46 which may, for example, be surrounded by a foam synthetic material, with the arm rest 45 being connected with one another by means of a tubular connecting piece 47 having a closing strip 48 secured directly thereto, by, for example, welding or the like. The arm rests 44, 45 in FIGS. 11*a* and 11*b* may be used instead of the arm rest 11 of FIG. 5 and the closing strip 20 illustrated therein.

As shown most clearly in FIG. 12, a pedestal or base plate 49 for a chair may be provided with a plurality of sliding legs 50 made, for example, of a plastic material, with the legs 50 being adapted to be mounted in corresponding receiving holes in the pedestal base 49 by a guide pin 51.

A conical opening 52 is arranged in a center area of the pedestal base 49, with the conical opening 52 being adapted to accommodate a lower conically tapering end of a connecting member 53. An axial thrust bearing arrangement 54 is disposed in the connecting member 53. An axial thrust bearing arrangement 54 is disposed in the connecting member 53. A connecting pin member 55 is disposed in the connecting piece 53 and is supported by a axial thrust bearing means 54 so as to enable a rotation thereof. In order to increase a sliding ability of the connecting member 53, it is possible to provide a shell 56 of a friction reducing material, with the shell enclosing a central cylindrical section of the connection pin 55.

The bracing or support tube 57 is mounted on the upper conical or truncated cone-shaped end of the connecting pin 55, with the bracing or support tube 57 being secured by, for example, welding or the like to the clamping member 7. In this situation, a reinforcing plate 58 may also be provided between the clamping member 7 and a bottom side of the bracing or support tube 57. By virtue of the provision of a large connecting pin 55 in the construction of FIG. 12, a vertical adjustment of the seat would not be possible.

As shown in FIG. 13, rather than a connecting pin 55 and connecting member 53, it is possible to provide a connecting pin means 59 which represents the only connecting piece between the leg plate 49 and brace or support tube 57. In this connection, the pin means 59 would be adapted to fix itself in the pedestal base plate 49 and the bracing or support tube 57 in such a manner so as to be resistant to a twisting or pivoting action so that, with the pin means 59, the resulting chair would be rigid and not be adapted to be rotated.

FIGS. 14 and 15 provide further examples of the manner by which the support or brace member may be connected in a area of a connection point of the seat portion and backrest. More particularly, as shown in FIGS. 14 and 15, a bracing or support tube 60 is secured to a metal frame member 61 of a seat portion and a metal frame member 62 of a backrest of a chair, with a joint means 63 being provided. The support or bracing tube 60 has an upper slightly conically tapering end 64 which is adapted to be accommodated in a receiving opening of the joint means 63. The joint means 63 includes a curved or arcuate section 65 adapted to extend under a clamping member 66. Prior to an insertion of the support or bracing member 60 into the joint means 63, the joint means 63 is first fastened to a lower curved or arcuate section 68 of the clamping member 66. The fastening may be accomplished by employing, for example, two screws 67 or the like, which screws, in order to increase stability of the chair, may penetrate the metal frame member 61 of the seat portion.

However, it is also possible, as shown in FIGS. 16 and 17, for the connecting area or points to be provided with a joint means 72 between a tubular support or brace member 69 and metal frame members 70, 71 of the seat and backrest. The joint means 72 includes a curved or arcuate section 73 adapted to enclose a lower half of a clamping member 74. The joint means 72, the clamping member 74, and the metal frame member 70 of the seat are provided with tandem through-holes into which a sturdy pin member 75 may be pressed so as to hold the joint means 72 at the clamping member 74. A tapered end 76 of the support or bracing member 69 is pressed into a tapered or conical opening of the joint means 72. The support or brace member 69 is held especially tightly and securely at the joint means 72 by way of a pin means 77 having a substantially wedge-shape cross sectional configuration. The pin means 77 includes an inclined surface portion 78, with the pin means 77 supporting itself along the inclined surface 78, on a side of the joint means 73 facing away from a clamping member 74, at a ball or cylindrical member 79 which is securely clamped in the support or bracing member 69.

While I have shown and described several embodiments in accordance with the present invention, it is understood that the same is not limited thereto but is susceptible of numerous changes and modifications as known to one having ordinary skill in the art and I therefore do not wish to be limited to the details shown and described herein, but intend to cover all such modifications as are encompassed by the scope of the appended claims.

I claim:

1. A chair comprising a first frame means for forming a seat portion, a second frame means for forming a backrest portion, and a substantially flat flexible means adapted to be disposed on said first and second frame means, longitudinally extending groove means formed in each frame for accommodating egdes of said flexible means, means formed in said groove means for enabling a securing of the edges of said flexible means in said groove means including a plurality of undercut means provided in wall areas of the groove means for forming barbs for enabling a securing of said flexible means in said groove means, and a squeezable soft metal member adapted to be pressed into the groove means with the edges of said flexible means whereby said flexible means is tightly secured to said respective frame means.

2. A chair according to claim 1, wherein each of said frame means are metal and formed as extruded members.

3. A chair according to claim 1, wherein the squeezable soft metal member is a soft metallic wire.

4. A chair according to claim 1, wherein the flexible means is one of a web or net type material.

5. A chair according to claim 5, wherein the net type material is one of knitted, woven, and braided from one of a single or multiple synthetic threads.

6. A chair according to claim 1, wherein walls of the groove means are disposed so as to extend at a predetermined angle with respect to adjacent areas of the flat flexible means.

7. A chair according to claim 1, wherein said longitudinally extending groove means is formed on a side of the respective frame means facing a user of the chair; a further longitudinally extending groove means is provided in each of the frame means at a predetermined angular distance under the flexible means, and in that a strip means is provided and is accommodated in the groove means of the respective frame means, said strip means spanning the frame means on an exterior side thereof.

8. A chair according to claim 7, wherein the angular distance is greater than 90°.

9. A chair according to claim 1, wherein portions of each of said frame means defining lateral sides of the seat portion and backrest are convexly bowed and front and rear sides of the first frame means and top and bottom sides of the second frame means are concavely bowed.

10. A chair according to claim 1, wherein portions of said first and second frame means are arranged in parallel to each other, means are provided for clamping said parallel portions together, and means are interposed between said parallel portions for maintaining the frame means in said clamping means.

11. A chair comprising a first frame means for forming a seat portion, a second frame means for forming a back rest portion, and a substantially flat flexible means adapted to be disposed on said first and second frame means, longitudinally extending groove means formed in each frame means for accommodating edges of said flexible means, means formed in said groove means for enabling a securing of the edges of said flexible means in said groove means including a plurality of undercut means provided in wall areas of the groove means for forming barbs, compressible means formed as a compressible member and being adapted to be pressed into the groove means with the edges of said flexible means whereby said flexible means is tightly secured to said respective frame means, portions of said first and second frame means are arranged in parallel to each other, means are provided for clamping said parallel portions together, and means are interposed between said parallel portions of said first and second frame means for maintaining the frame means in said clamping means, and wherein, said means for clamping has a substantially double C-shaped profile including two juxtaposed arcuate portions accommodating said parallel portions of said frame means, and wherein said means for maintaining includes an arcuate closing strip means pressed between the parallel portions of the frame means.

12. A chair according to claim 11, wherein a support means is connected to a longitudinal center area of said means for clamping, said support means including a tubular member disposed beneath the seat portion and extending downward therefrom along an arcuate path, said tubular member includes a tapered end portion adapted to accommodate a connecting means of a pedestal portion of the chair.

13. A chair according to claim 12, wherein said connecting means includes a first tubular connecting member mounted at the pedestal portion of the chair, a second connecting member disposed in said first tubular connecting member, and thrust bearing means arranged in said first tubular connecting member for rotatably mounting said second connecting member therein.

14. A chair according to claim 13, wherein said first tubular connecting member has a tapering lower end portion, the pedestal portion is provided with a tapered receiving hole for accommodating the lower end portion of the first tubular connecting member.

15. A chair according to claim 13, wherein means are interposed between the first tubular connecting member and the second connecting member for reducing friction therebetween.

16. A chair according to claim 15, wherein said means for reducing friction includes a shell means lining at least a central area of said first tubular connecting member.

17. A chair according to claim 13, wherein said second connecting member is formed as a self-locking pneumatic cylinder-piston means for enabling an adjustment of the chair, a cylinder of said cylinder-piston means being rotatably mounted in said first tubular connecting member, and wherein a piston rod of a piston of the cylinder-piston means has one end thereof supported by said bearing means.

18. A chair according to claim 12, wherein the pedestal portion includes a round metal base disc having a plurality of sliding means arranged at least around a peripheral edge of the base disc.

19. A chair according to claim 11, further comprising at least two arm rest means joined in a central area thereof by a section extending in parallel to the parallel portions of said frame means, and means provided in said arm rest means for enabling the arm rest means to be mounted at the means for maintaining the frame means in the clamping means.

20. A chair according to claim 19, further comprising closing strip means secured to the central area of said arm rest means.

21. A chair according to claim 19, wherein said means for enabling the arm rest means to be mounted includes a groove means at least in the central area thereof for accommodating the means for maintaining.

22. A chair according to claim 12, wherein a cover means is provided for covering said means for maintaining the frame means in said clamping means.

23. A chair according to claim 1, wherein portions of said first and second frame means are arranged in parallel to each other, means are provided for clamping said parallel portions together, the support means is connected to a longitudinal center area of said means for clamping, said support means being disposed in a longitudinal center area of said means for clamping, said support means including a tubular member disposed beneath the seat portion and extending downward therefrom along an arcuate path, and joint means are provided for connecting an upper end of said support means to said means for clamping and one of the frame means.

24. A chair according to claim 23, wherein the upper end of the support means has a tapered configuration, and the joint means further includes a tapered hole for accommodating the upper end of the support means.

25. A chair according to claim 1, wherein means are provided for clamping the frame means to each other, and means are interposed between the frame means for maintaining the frame means in the clamping means.

26. A chair according to claim 25, wherein said means for clamping has a substantially double C-shaped profile including two overlying arcuate portions accommdating portions of said frame means, and wherein said means for maintaining includes an arcuate means pressed between the portions of the frame means.

27. A chair according to claim 26, wherein means are provided for mounting the chair on a pedestal base including a first tubular connecting member mounted at the pedestal base of the chair, a second connecting member disposed in said first tubular connecting member, and thrust bearing means arranged in said first tubular connecting member for rotatably mounting said second connecting member therein.

28. A chair according to claim 27, wherein said first tubular connecting member has a tapering lower end portion, the pedestal base is provided with a tapered receiving hole for accommodating the lower end portion of the first tubular connecting member.

29. A chair according to claim 27, wherein the second connecting member is formed as a self-locking pneumatic cylinder piston means for enabling an adjustment of the chair, a cylinder of said cylinder-piston means being rotatably mounted in said first tubular connecting member, and wherein a piston rod of a piston of the cylinder-piston means has one end thereof supported by said bearing means.

30. A chair according to claim 11, wherein said means for maintaining includes a metal spline member separating the frame means and applying a force thereon to maintain the frame means in the clamping means.

31. A chair according to claim 30, further comprising resilient means interposed between the spline member and the respective frame means.

32. A chair according to claim 11, wherein a further longitudinally extending groove means is formed in each of said frame means at a predetermined angular distance from the first mentioned groove means, and an extruded cover means is provided for covering said frame means, said cover means including a first edge portion adapted to be accommodated in the groove means accommodating the flexible means, and a second end portion adapted to be accommodated in the further groove means.

33. A chair according to claim 30, further comprising arm rest means, mounting means provided on the arm rest means for enabling the arm rest means to be mounted on said spline member so as to affix said arm rest means to the chair.

34. A chair according to claim 33, wherein said mounting means includes a groove formed at least in a portion of the arm rest means, an edge of said spline member being forced into the groove of the arm rest means.

35. A chair according to claim 34, the arm rest means is formed as an extruded member.

36. A chair comprising a first frame means for forming a seat portion, a second frame means for forming a back rest portion, and a substantially flat flexible means adapted to be disposed and tightly secured on said first and second frame means, wherein arcuate portions of said first and second frame means are arranged in parallel to each other, arcuate means with a substantially double C-shaped profile including two juxtaposed arcuate portions are provided for clamping said parallel portions together, and an arcuate closing strip means is interposed between said parallel portions for maintaining the frame means in said clamping means.

37. A chair according to claim 36, wherein longitudinally extending groove means are formed all around in each frame means for accommodating edges of said flexible means, a plurality of undercut means are provided in wall areas of the groove means for forming barbs for enabling a securing of edges of said flexible means in said groove means, and a squeezable soft metal member is adapted to be pressed into the groove means with the edges of said flexible means.

38. A chair according to claim 36, wherein portions of each of said frame means defining lateral sides of the seat portion and back rest are convexly bowed and front and rear sides of the first frame means and top and bottom sides of the second frame means are concavely bowed.

39. A chair according to claim 36, wherein a support means is connected to a longitudinal center area of said means for clamping, said support means including tubular member disposed beneath the seat portion and extending downward therefrom along an arcuate path, said tubular member includes a tapered end portion adapted to communicate a connecting means on a pedestal portion of the chair.

40. A chair according to claim 39, wherein said connecting means includes a first tubular connecting member mounted at the pedestal portion of the chair, a second connecting member disposed in said first tubular connecting member, and a thrust bearing means arranged in said first tubular connecting member for rotatably mounting said second connecting member therein.

41. A chair according to claim 40, wherein said first tubular connecting member has a tapering lower end portion, the pedestal portion is provided with a tapered receiving hole for accommodating the lower end portion of the first tubular connecting member.

42. A chair according to claim 40, wherein means are interposed between the first tubular connecting member and the second connecting member for reducing friction therebetween.

43. A chair according to claim 42, wherein said means for reducing friction includes a shell means lining at least a central area of said first tubular connecting member.

44. A chair according to claim 40, wherein said second connecting member is formed as a self-locking pneumatic cylinder-piston means for enabling an adjustment of the chair, a cylinder of said cylinder-piston means being rotatably mounted in said first tubular connecting member, and wherein a piston rod of a piston of the cylinder-piston means has one end thereof supported by said bearing means.

45. A chair according to claim 39, wherein the pedestal portion includes a round metal base disc having a plurality of sliding means arranged at least around a peripheral edge of the base disc.

46. A chair according to claim 36, further comprising at least two arm rest means joined in a central area thereof by a section extending and parallel to the parallel portions of said frame means, and means provided in said arm rest means for enabling the arm rest means to be mounted at the means for maintaining the frame means in the clamping means.

47. A chair according to claim 46, further comprising closing strip means secured to the central area of said arm rest means.

48. A chair according to claim 46, wherein said means for enabling the arm rest means to be mounted includes a groove means at least in the central area thereof for accommodating the means for maintaining.

49. A chair according to claim 38, wherein a cover means is provided for covering said means for maintaining, the frame means in said clamping means.

50. A chair according to claim 38, wherein said means for maintaining includes a metal spline member separating the frame means and applying a force thereon to maintain the frame means in the clamping means.

51. A chair according to claim 50, further comprising resilient means interposed between the spline member and the respective frame means.

52. A chair according to claim 50, further comprising arm rest means, mounting means provided on the arm rest means for enabling the arm rest means to be mounted on said spline member so as to affix said arm rest means to the chair.

53. A chair according to claim 52, wherein said mounting means includes a groove formed at least in a portion of the arm rest means, an edge of said spline member being forced into the groove of the arm rest means.

54. A chair according to claim 53, wherein the arm rest means is formed as an extruded member.

* * * * *

UNITED STATES PATENT AND TRADEMARK OFFICE

CERTIFICATE OF CORRECTION

PATENT NO. : 4,552,406

DATED : November 12, 1985

INVENTOR(S) : Herbert OHL

It is certified that error appears in the above-identified patent and that said Letters Patent is hereby corrected as shown below:

On the title page;

[73] Assignee: Wilkhahn Wilkening & Hahne GmbH & Co.

Signed and Sealed this

*Eighth* Day of *April 1986*

[SEAL]

*Attest:*

DONALD J. QUIGG

*Attesting Officer*

*Commissioner of Patents and Trademarks*